US005339230A

United States Patent [19]

Devorris

[11] Patent Number: 5,339,230

[45] Date of Patent: Aug. 16, 1994

[54] ENCAPSULATED CHARGED GAS LIGHT APPARATUS

[76] Inventor: Philip E. Devorris, 305 Fairways, Hollidaysburg, Pa. 16648

[21] Appl. No.: 115,940

[22] Filed: Sep. 1, 1993

[51] Int. Cl.[5] ..... F21S 3/00

[52] U.S. Cl. ..... 362/216; 362/223; 362/267

[58] Field of Search ..... 362/216, 217, 223, 260, 362/263, 267, 362

[56] References Cited

U.S. PATENT DOCUMENTS

| | | | |
|---|---|---|---|
| 1,854,357 | 4/1932 | Niley | 362/216 |
| 1,993,943 | 3/1935 | Nunez . | |
| 2,562,740 | 7/1951 | Rizer . | |
| 3,544,782 | 12/1970 | Hahn . | |
| 3,550,298 | 12/1970 | O'Neill . | |
| 4,039,894 | 8/1977 | Gardner, III . | |
| 4,064,430 | 12/1977 | Owens . | |
| 4,283,758 | 8/1981 | Irving . | |
| 4,569,004 | 2/1986 | Peterson | 362/216 |
| 4,703,574 | 11/1987 | Garjian . | |
| 4,947,301 | 8/1990 | Steele . | |
| 4,977,490 | 12/1990 | Davies . | |
| 4,998,365 | 3/1991 | Bezek . | |
| 5,117,345 | 5/1992 | Baake | 362/216 |
| 5,142,466 | 8/1992 | Foster et al. | 362/223 |
| 5,150,961 | 9/1992 | Gonzalez . | |
| 5,192,125 | 3/1993 | Gonzalez . | |
| 5,255,166 | 10/1993 | Gonzalez | 362/216 |

FOREIGN PATENT DOCUMENTS

| | | |
|---|---|---|
| 2052192 | 3/1971 | France . |
| 1204372 | 9/1970 | United Kingdom . |

OTHER PUBLICATIONS

Advertisement: RNR Technologies, Inc. for Neostix (Decorative Lighting Apparatus).

*Primary Examiner*—Richard R. Cole

*Attorney, Agent, or Firm*—Pennie J. Edmonds

[57] ABSTRACT

An lighting apparatus comprising an elongated tubular housing for snugly receiving therein a charged gas light source, such as, a neon lighting assembly. A power source is connected to the light source by electric power cords which pass through one of two endcaps removably secured to the ends of the housing. The light source includes at least one elongated glass tube containing a neon gas mixture having both ends of the tube bent back along itself such that the ends are secured within the housing away from the open housing ends. Alternatively, the housing can be comprised of a base and cover member slidingly received within the base, thereby forming a central opening therebetween for receiving therein the light source, wherein the side walls of the base and cover member substantially overlap for preventing electricity from passing therethrough.

21 Claims, 1 Drawing Sheet

ENCAPSULATED CHARGED GAS LIGHT APPARATUS

TECHNICAL FIELD

The present invention generally relates to charged gas lighting instruments, such as, neon lighting devices.

BACKGROUND OF THE INVENTION

Well known examples of charged gas lighting instruments include neon lighted beer signs for smallscale, indoor application, and neon lighted billboards for outdoor, large-scale operation. Most often these type of charged gas lighting instruments utilize glass lighting tubes. The tubes are filled with an assortment of light emissive gas mixtures which often include neon gas. Depending on the mixtures, different colors of brightly glowing light, commonly referred to as "neon light," can be created when the gases contained in the glass tubes are subjected to an electrical discharge.

In most commercial settings (e.g., beer signs and billboards) the unprotected, glass tubes are secured to a frame, or in some cases, directly to the facade of a building for display. The fragile tubes, however, are highly susceptible to breaking. Indeed, quite often the tubes are damaged during shipping or installation procedures. Moreover, it is exceptionally difficult to reuse or relocate the tubes once they have been installed. When used outdoors, exposed tubes and their respective electrical fittings are extremely vulnerable to the outside elements. In addition, a charged gas lighting device, such as a neon light, utilizes a high voltage power source (e.g., 10,000 volts), and is therefore relatively dangerous. These devices should be installed and maintained only by a professional electric sign installer.

Various methods of protecting the glass tubes and electrical fittings are known in the art. They include U.S. Pat. No. 4,947,301 to Steele describing a non-conductive housing for sheltering the electrode ends and high voltage conductors of a neon tube; and U.S. Pat. Nos. 5,150,961 and 5,192,125 to Gonzalez describing apparatuses for illuminating a vehicle license plate including an annular neon tube mounted within a front transparent channel member and a rear protective cover plate.

There are various drawbacks, however, with the prior art. In particular, the apparatus as described in Steele mounts the neon tube to the housing exterior thereby exposing the fragile tube to the outside elements and greatly increasing the likelihood that the unprotected tube will be prematurely broken. The broken glass, or high voltage current from the wires attached to a damaged tube, poses a serious injury risk.

Even prior art devices which locate the neon tube within a housing do not eliminate the risk of high voltage shock. For instance, the apparatuses as described in the Gonzalez patents enclose the neon tube within a front transparent channel member and a rear protective cover plate. Although this protects an individual from accidentally touching the neon tube's high voltage electrical connections, the front and back covers create a seam through which a high voltage current may pass. That is, it is possible for electric current to arc from the electrical fittings through a seam in the housing. It is even more likely to occur if a conductive apparatus, like a metal screwdriver, is placed at or near the seam which is likely to occur during installation or maintenance procedures. In addition, electricity which arcs through a seam in the housing presents a serious fire hazard.

Also known in the art is U.S. Pat. No. 2,562,740 to Rizer describing a tubular florescent element covered by flexible plastic tubing also for illuminating a license plate. The flexible tube, however, does little to protect the neon tube from breaking upon a heavy impact, or insulate the electrical connections from delivering an electric shock.

SUMMARY OF THE INVENTION

In light of the aforementioned drawbacks with the prior art, it is a particular objective of this invention to protect a charged gas lighting source, such as, a neon light assembly and its electrical fittings from damage while preventing the possibility of electric shock or fire. To achieve this objective the present invention comprises an elongated tubular housing, made of a dielectric material, a charged gas light source snugly received within the tubular housing, and at least one conducting element, such as, a power cord, which passes through one of two endcaps removably secured to the ends of the housing. In particular, the charged gas light source comprises an elongated glass tube having sealed ends containing a gas having high electrical conductivity and light emissive power; such as, a neon gas mixture. The glass tube is bent back along itself at two points such that the ends of the tube are secured suitably within the housing to prevent electricity from arcing through the open ends of the housing or the possibility of someone accidentally touching the electrical connections.

By acutely angling the ends of the glass tube, such that the ends are positioned to the rear and center of the tube, the fully lit center portion of the tube is exposed. This allows a plurality of light apparatuses to be placed end-to-end to form a continuous light source—i.e., without noticeable gaps between successive lighting apparatuses, which is an additional drawback of existing light fixtures.

Alternatively, the housing can be comprised of a base member and a cover member slidingly received within the base member thereby forming a central opening for snugly receiving therein the light source. The side walls of the base and cover member substantially overlap for preventing electricity from passing through the seam created in the housing wall. This also allows for shaped glass tubes to be received within the protective housing.

It is a further object of the present invention to provide a reusable neon light source which is capable of being removed from one location and reassembled at a different location, and/or rearranged in a different design. To achieve this objective the housing further comprises means for mounting the apparatus to an object; such as, extension pieces adapted to receive screws or nails therethrough. Also, in furtherance of this objective, the power cords utilized in this invention are adapted for quick connection and disconnection with a power source, and/or a successive light apparatus.

Further to the benefits described above, the present invention is safe for interior as well as exterior use, and can be rapidly installed and maintained by a person unfamiliar with charged gas lighting instruments.

DETAILED DESCRIPTION OF THE PREFERRED EMBODIMENT

UL (United Laboratories) standards of safety require devices utilizing high voltages, such as neon lighting devices, to have at least a 1.5 inch space between all electrical connections and any openings or seams in the housing. This prevents the possibility of electricity arcing from the electrical connections through a seam in the housing wall and delivering an electric shock or causing an electrical fire.

Figure 1:
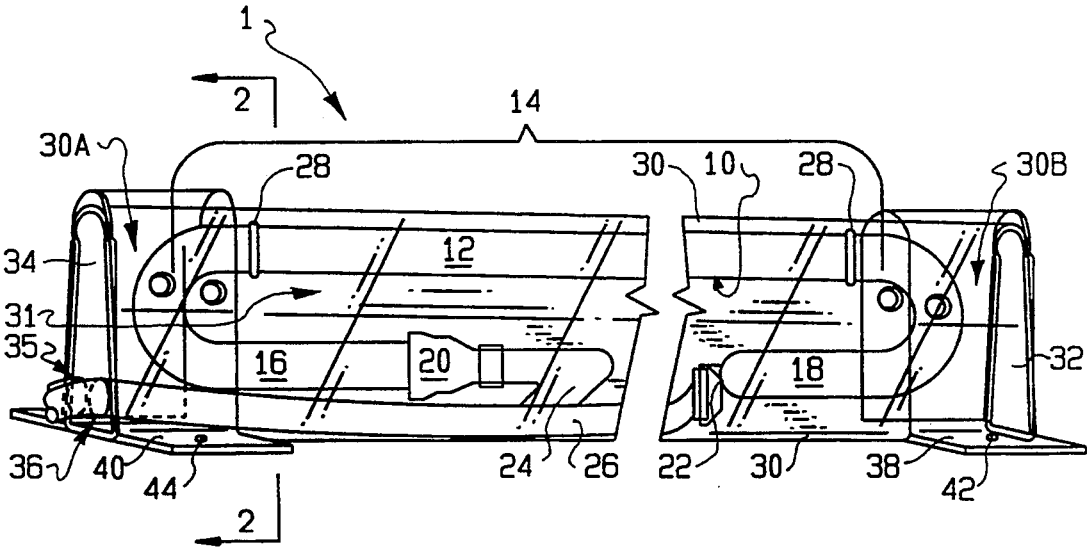
FIG. 1 is an overall perspective view of the encapsulated charged gas light apparatus of the present invention.

Referring to FIG. 1, charged gas light apparatus 1 meets such industry safety standards. Charged gas light apparatus 1 includes protective housing 30, a one-piece, substantially rigid encasing having a central opening 31 for snugly receiving therein charged gas light source 10. Housing 30 also is made of a material that is dielectrically sound for the high voltages required for charged gas lighting operations, thus preventing any possibility of electricity passing directly through the housing wall.

Mounted within housing 30 is charged gas light source 10 which includes a single glass tube 12. Glass tube 12 contains a light emissive gas, such as, neon. Neon or argon are common examples of light emissive gases which "glow" or produce light when subjected to an electrical discharge. Usually, neon or a gaseous mixture containing neon is preferred for commercial use.

Glass tube 12 includes end portions 16 and 18 which are bent back along the tube (i.e., to the rear and center of the tube) substantially parallel to the wall of housing 30. This secures electrical connections 20 and 22 at the sealed ends of tube 12 sufficiently within housing 30 thereby preventing electricity from arcing through the open ends of the housing, and keeping someone from accidentally touching the electrical connections. The ends of tube 12 may be substantially adjacent to each other near the midpoint of housing 30, although this is not necessary, nor preferred for longer lighting apparatuses 1. In order to satisfy UL safety standards, as described above, electrical connections 20 and 22 should be secured within housing 30 at least 1.5 inches from open ends 30A and 30B. Accordingly, light apparatus 1 is safe for indoor and outdoor use, and can be installed by a person unfamiliar with this type of lighting, which eliminates the need for installation and wiring by a professional electric sign installer.

Housing 30 also protects glass tube 12 and electrical connections 20 and 22 from the outside elements; such as, hail stones that would destroy the fragile glass tube, and rain or moisture that would prematurely corrode the electrical connections. Moreover, housing 30 safeguards glass tube 12 from contact with other objects that would destroy an exposed tube; a common problem occurring during installation, shipping or transportation. As a result, housing 30 reduces wasted product.

Figure 5:
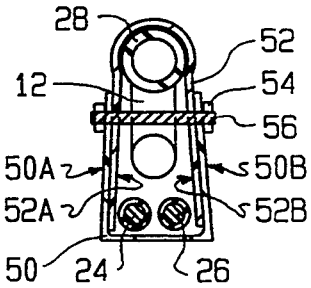
FIG. 5 is a cross-sectional view of the encapsulated charged gas light apparatus of the present invention showing a two-part housing having overlapping side walls.

Referring to FIG. 5, it is further contemplated that housing 30 can be made in two parts. Housing base 50 is configured to slidingly receive therein cover member 52 whereby side walls 50A and 50B of housing base 50, and side walls 52A and 52B of cover member 52 substantially overlap to prevent electricity from arcing through the seam created between the housing base and cover member. To satisfy UL safety standards, the side walls of the base and cover member overlap by at least 1.5 inches. A two-part housing allows for a shaped glass lighting tube 12 to be secured between housing base 50 and cover member 52. Alternatively, housing base 50 can be received within cover member 52 without departing from the scope of the present invention.

Housing base 50 and cover member 52 are secured together by a nut 54 and bolt 56 assembly made of non-conductive material, wherein bolt 56 passes through side walls 50A, 52A, 52B and 50B, respectively. Alternatively, housing base 50 and cover member 52 may be secured together by other means known to a person skilled in the art without departing from the scope of the present invention.

Figure 4:
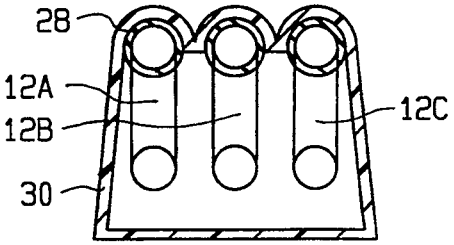
FIG. 4 is a cross-sectional view of the encapsulated charged gas light apparatus of the present invention having multiple lighting tubes.

As previously mentioned, charged gas light source 10 includes a single glass tube 12, although as shown in FIG. 4, a plurality of glass tubes 12A, 12B and 12C (each containing a different light emissive gas mixture for creating different colors of light, if so desired) can be incorporated into a single housing 30.

Normally, the ends of a charged gas lighting tube are not as brightly lit as the center portion of the tube. Referring back to FIG. 1, as previously described, ends 16 and 18 of glass tube 12 are angled approximately 180° to the rear and center of the tube thus creating elongated center portion 14. During operation the fully lit center portion 14 of tube 12 fills the entire length of transparent housing 30. Therefore, successive encapsulated light apparatuses 1 can be placed end-to-end to form a "continuous" lighting effect—i.e., without noticeable gaps between successive light apparatuses 1.

Figure 2:
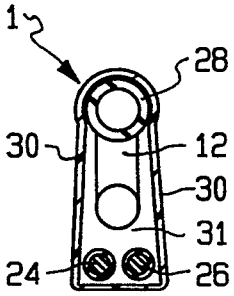
FIG. 2 is a cross-sectional view of the encapsulated charged gas light apparatus of the present invention taken along line 2—2 of FIG. 1.

Positioned along the length of tube 12 are a number of rubber O-rings 28 (also shown in FIG. 2) to minimize the movement of the tube within housing 30 and protect the tube from coming into contact with the inner wall of the housing and breaking. Preferably, the curvature of O-rings 28 are commensurate with the curvature of the inside wall of housing 30 thereby firmly securing glass tube 12 (and more generally, charged gas light source 10) therein.

Referring to FIG. 1, glass tube 12 is connected to a power source (e.g., a transformer, not shown) or a successive neon light apparatus 1 by two covered electrical power cords 24 and 26 attached to the ends of tube 12 at electrical connections 20 and 22. The power source provides an electrical discharge which passes through the light emissive gas contained in glass tube 12 thereby causing the gas to "glow" and emit light.

Power cords 24 and 26 are fitted with electrical plug ends (not shown), or other means for facilitating connecting or disconnecting each charged gas light apparatus 1 with a power source or successive charged gas light apparatus having appropriate electrical fittings for receiving the plug ends. As such, light apparatus 1 can be quickly and efficiently relocated with no rewiring or professional assistance required.

Figure 3:
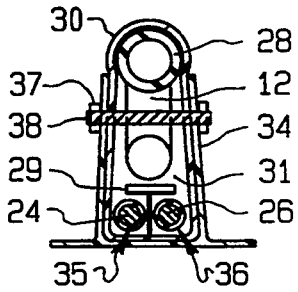
FIG. 3 is an end view of the encapsulated charged gas light apparatus of the present invention showing the electrical power line cords passing through an aperture in the end cap and an element for reflecting light towards the front of the housing.

Referring to FIG. 3, because housing 30 is transparent and allows light to emit in all directions, a mirror 29 or other reflective material, such as reflective paint, may be secured to the rear of housing 30 for reflecting a substantial portion of the light emitted from tube 12 towards the front portion of the housing. Also, it is contemplated that housing 30 may be comprised of a translucent material for achieving a different lighting effect.

Referring back to FIG. 1, as previously described, housing 30 is approximately the same length as elongated center portion 14 of glass tube 12. This allows center portion 14 to fill the entire length of housing 30 which not only permits a user to create a "continuous" lighting effect between successive encapsulated neon light apparatuses 1, but also prevents movement of neon tube assembly 10 within housing 30 once endcaps 32 and 34 are secured thereon.

Because a 1.5 inch space between the inside wall of housing 30 and electrical connections 20 and 22 is not necessary, housing 30 also is dimensioned to closely receive therein the cross-sectional profile of charged gas light source 10. This includes tube 12, ends portions 16 and 18, electrical power cords 24 and 26, and any necessary electrical fittings and wires. Similarly, this prevents any excessive movement of charged gas light source 10 within housing 30, as well as, reduces the cross-sectional size of light apparatus 1.

Endcaps 32 and 34 not only secure charged gas light source 10 within housing 30, preventing any unwanted movement of the assembly, but they also seal open ends 30A and 30B of housing 30 protecting light source 10 from moisture and the elements. Similar to housing base 50 and cover member 52, open ends 30A and 30B of housing 30 are slidingly received within endcaps 32 and 34, substantially overlapping at each end for preventing electricity from arcing through the seams created at the ends of the housing; for instance, overlapping by at least 1.5 inches as an added measure of safety (e.g., in addition to electrical connections 20 and 22 being secured within housing 30 at least 1.5 inches from openings 30A and In particular, endcap 32 is solid in construction thereby sealing end 30B. Referring to FIGS. 1 and 3, endcap 34 is provided with apertures 35 and 36 through which passes electrical power cords 24 and 26. Apertures 35 and 36 may be designed to receive therethrough electric power cords 24 and 26 in a fluid-tight manner if so desired. Endcaps 32 and 34 are removably secured to housing 30 by a nut 37 and bolt 38 assembly, or any other means known in the art.

Referring to FIG. 1, as a means of securing charged gas light apparatus 1 in place, for example to an interior or exterior wall, mounting members, such as extensions 38 and 40 with holes 42 and 44 for receiving screws or nails therethrough, are secured to housing 30. Extensions 38 and 40 can be part of endcaps 32 and 34 (FIG. 1), or alternatively part of housing 30 (not shown). This permits charged gas light apparatus 1 to be arranged in any pattern or design, then removed and rearranged in a different design, or reused at a different location. Therefore, charged gas light apparatus 1 is a replacement for the non-reusable "exposed neon" tubes which are presently used in the market. Alternatively, hook and loop material may be used to secure neon light apparatus 1 in place.

I claim:

1. A lighting apparatus, comprising:

an elongated tubular housing member having a front and rear, and first and second open ends;

a charged gas light source configured and dimensioned to be snugly received within said tubular member;

at least one conducting element for connecting said light source to a power source, said element passing through one said open end and being connected to said light source at a point spaced from both said open ends; and first and second endcap members removably secured to and sealing said open ends, wherein one said endcap member defines an operative passage for said conducting element therethrough.

2. The apparatus according to claim 1, wherein said light source comprises:

at least one elongated glass tube having sealed ends and containing a light emissive gas, said tube being bent back along itself at two points such that said ends are secured within said tubular housing member; and electrical connector means mounted in each glass tube for connection with said conducting element and to provide an electrical discharge through said gas.

3. The apparatus according to claim 2, wherein said light emissive gas comprises neon.

4. The apparatus according to claim 2, wherein said tubular housing member has sufficient rigidity and impact resistance to prevent damage to said glass tube during normal use, installation and transport.

5. The apparatus according to claim 2, wherein said sealed ends of said glass tube are secured within said tubular housing member at least 1.5 inches from said open ends.

6. The apparatus according to claim 2, wherein said sealed ends of said glass tube are substantially adjacent to each other near the midpoint of said tubular housing member.

7. The apparatus according to claim 2 further comprising resilient spacer means for securing said glass tube within said tubular housing member.

8. The apparatus according to claim 7, wherein said resilient spacer means comprise at least one rubber O-ring mounted on said glass tube.

9. The apparatus according to claim 1, wherein said tubular housing member comprises one piece.

10. The apparatus according to claim 1, wherein said tubular housing member comprises:

a base member having first and second side walls; and a cover member, having first and second side walls, slidingly received within said base member forming a central opening therebetween for snugly receiving therein said charged gas light source, and said first and second side walls of said cover member and said base member overlapping for preventing electricity from passing therethrough.

11. The apparatus according to claim 10, wherein said side walls of said cover member and said base member overlap by at least 1.5 inches.

12. The apparatus according to claim 1, wherein said tubular housing comprises a dielectric material.

13. The apparatus according to claim 1, wherein said light apparatus further comprises means for mounting said apparatus to an object.

14. The apparatus according to claim 13, wherein the means for mounting comprise at least one extension piece secured to said housing having holes therein for receiving holding members therethrough.

15. The apparatus according to claim 1, wherein said conducting element is adapted to facilitate connection and disconnection with electrical devices selected from the group consisting of said power source and an additional lighting apparatus.

16. The apparatus according to claim 1 further comprising a means for reflecting a significant portion of light emitted from said charged gas light source substantially towards the front of said housing.

17. The apparatus according to claim 16, wherein the means for reflecting comprises an elongated mirror secured to said rear of said housing.

18. The apparatus according to claim 1, wherein said endcap member receives therethrough said conducting element in a fluid-tight manner.

19. The apparatus according to claim 1, wherein said endcap members overlap said open ends by at least 1.5 inches.

20. A lighting apparatus, comprising:

a one piece elongated tubular housing member having and first and second open ends;

at least one elongated glass tube, configured and dimensioned to be snugly received within said tubular housing member, having sealed ends and containing a neon gas mixture, said tube being bent back along itself at two points such that said ends are secured within said tubular housing member away from said open ends;

electrical connector means mounted in each glass tube for connection with a conducting element and to provide an electrical discharge through said gas;

at least one conducting element for connecting said light source to a power source, said element passing through one said open end and being connected to said light source at a point spaced from both said open ends;

first and second endcap members removably secured to and sealing said open ends, wherein one said endcap member defines an operative passage for said conducting element therethrough; and means for mounting said apparatus to an object.

21. A lighting apparatus, comprising:

an elongated tubular housing member having and first and second open ends comprising, a base member having first and second side walls, and a cover member, having first and second side walls, slidingly received within said base member forming a central opening therebetween, and said first and second side walls of said cover member and said base member overlapping for preventing the passage of electricity therethrough;

at least one elongated glass tube, configured and dimensioned to be snugly received within said tubular housing member, having sealed ends and containing a neon gas mixture, said tube being bent back along itself at two points such that said ends are secured within said tubular housing member away from said open ends;

electrical connector means mounted in each glass tube for connection with a conducting element and to provide an electrical discharge through said gas;

at least one conducting element for connecting said light source to a power source, said element passing through one said open end and being connected to said light source at a point spaced from both said open ends;

first and second endcap members removably secured to and sealing said open ends, wherein one said endcap member defines an operative passage for said conducting element therethrough; and means for mounting said apparatus to an object.

* * * * *